US007023391B2

(12) United States Patent
Wuidart et al.

(10) Patent No.: US 7,023,391 B2
(45) Date of Patent: Apr. 4, 2006

(54) ELECTROMAGNETIC FIELD GENERATION ANTENNA FOR A TRANSPONDER

(75) Inventors: Luc Wuidart, Pourrieres (FR); Michel Bardouillet, Rousset (FR)

(73) Assignee: STMicroelectronics S.A., Montrouge (FR)

( * ) Notice: Subject to any disclaimer, the term of this patent is extended or adjusted under 35 U.S.C. 154(b) by 0 days.

(21) Appl. No.: 09/860,029

(22) Filed: May 17, 2001

(65) Prior Publication Data

US 2002/0003498 A1 Jan. 10, 2002

(30) Foreign Application Priority Data

May 17, 2000 (FR) ..... 00 06302

(51) Int. Cl.
*H01Q 9/00* (2006.01)

(52) U.S. Cl. ..... 343/749; 343/895; 340/505; 340/572.1; 235/492

(58) Field of Classification Search ..... 343/741, 343/742, 745, 749, 860, 866, 867, 895; 342/42, 342/43; 340/505, 572, 825.34; 235/380, 385, 235/439, 440, 492
See application file for complete search history.

(56) References Cited

U.S. PATENT DOCUMENTS 2,411,555 A * 11/1946 Rogers ..... 343/700 MS
3,618,089 A 11/1971 Moran et al. ..... 343/13 R (Continued)

FOREIGN PATENT DOCUMENTS

DE 28 35 549 A1 3/1979
DE 44 44 984 12/1994

(Continued)

OTHER PUBLICATIONS

French Search Report from French patent application No. 00/06302, filed May 17, 2000.
French Search Report from French Patent Application No. 99 09563, filed Jul. 20, 1999.
French Search Report from French Patent Application No. 98 08025, filed Jun. 22, 1998.
French Search Report from French Patent Application No. 99 04547, filed Apr. 7, 1999.
French Search Report from French Patent Application No. 99 04546, filed Apr. 7, 1999.
French Search Report from French Patent Application No. 98 08024, filed Jun. 22, 1998.
French Search Report from French Patent Application No. 99 04548, filed Apr. 7, 1999.
French Search Report from French Patent Application No. 99 04544, filed Apr. 7, 1999.
French Search Report French Patent Application No. 00/01214, Jan. 31, 2000.
French Search Report from French Patent Application No. 99 09564, filed Jul. 20, 1999.
French Search Report from French Patent Application No. 00/06301, filed May 17, 2000.
French Search Report from French Patent Application No. 99 04548, filed Apr. 7, 1999.
French Search Report from French Patent Application No. 99 04545, filed Apr. 7, 1999.
French Search Report from French Patent Application No. 99 07024, filed May 31, 1999.

(Continued)

*Primary Examiner*—Tan Ho
(74) *Attorney, Agent, or Firm*—Lisa K. Jorgenson; James H. Morris; Wolf, Greenfield & Sacks, P.C.

(57) ABSTRACT

An antenna for generating an electromagnetic field including several planar inductive cells parallel connected in an array and forming, in association with at least one capacitor, an oscillating circuit adapted to being excited by a high-frequency signal.

28 Claims, 2 Drawing Sheets

U.S. PATENT DOCUMENTS 4,068,232 A 1/1978 Meyers et al. ..... 343/6.8
4,209,783 A 6/1980 Ohyama et al.
4,278,977 A 7/1981 Nossen ..... 343/6.5
4,375,289 A 3/1983 Schmall et al.
4,408,185 A 10/1983 Rasmussen ..... 343/360
4,593,412 A * 6/1986 Jacob ..... 455/129
4,656,472 A 4/1987 Walton ..... 340/826
4,660,192 A 4/1987 Pomatto, Sr.
4,673,932 A 6/1987 Ekchian et al. ..... 340/825.54
4,706,050 A * 11/1987 Andrews ..... 29/600
4,782,308 A 11/1988 Trobec et al. ..... 331/65
4,802,080 A 1/1989 Bossi et al. ..... 363/75
4,814,595 A 3/1989 Gilboa ..... 235/492
4,827,266 A * 5/1989 Sato et al. ..... 343/700 MS
4,928,108 A * 5/1990 Kropielnicki et al. ..... 343/704
4,963,887 A 10/1990 Kawashima et al. ..... 342/484
5,013,898 A 5/1991 Glasspool ..... 325/444
5,055,853 A * 10/1991 Garnier ..... 343/769
5,084,699 A 1/1992 DeMichele ..... 340/825.54
5,099,227 A * 3/1992 Geiszler et al. ..... 235/440
5,126,749 A 6/1992 Kaltner ..... 343/742
5,142,292 A 8/1992 Chang ..... 343/742
5,202,644 A 4/1993 Brady
5,214,409 A 5/1993 Beigel
5,305,008 A 4/1994 Turner et al. ..... 342/449
5,324,315 A 6/1994 Grevious
5,452,344 A 9/1995 Larson ..... 379/67
5,493,267 A 2/1996 Ahlse et al. ..... 340/310.02
5,504,485 A 4/1996 Landt et al. ..... 342/44
5,519,381 A 5/1996 Marsh et al. ..... 340/572
5,521,602 A 5/1996 Carroll et al. ..... 342/50
5,541,604 A 7/1996 Meier ..... 342/42
5,550,536 A 8/1996 Flaxl ..... 340/825.5
5,604,411 A 2/1997 Venkitasubrahmanian et al. ..... 345/42
5,619,529 A 4/1997 Fujioka
5,621,411 A 4/1997 Hagl et al. ..... 342/42
5,691,605 A 11/1997 Xia et al. ..... 315/307
5,698,837 A 12/1997 Furuta
5,698,838 A 12/1997 Yamaguchi
5,701,121 A 12/1997 Murdoch
5,703,573 A 12/1997 Fujimoto et al. ..... 340/825.54
5,767,503 A 6/1998 Gloton ..... 338/487
5,801,372 A 9/1998 Yamaguchi ..... 235/492
5,831,257 A 11/1998 Yamaguchi ..... 235/492
5,850,416 A * 12/1998 Myer ..... 235/385
5,874,725 A 2/1999 Yamaguchi ..... 235/492
5,883,582 A 3/1999 Bowers et al.
5,889,273 A 3/1999 Goto
5,905,444 A * 5/1999 Zimmer ..... 235/380
5,955,950 A 9/1999 Gallagher, III et al.
6,014,088 A 1/2000 Van Santbrink et al.
6,025,780 A 2/2000 Bowers et al. ..... 340/825.52
6,028,503 A 2/2000 Preishuberpflugl et al. ..... 340/10.4
6,034,640 A * 3/2000 Oida et al. ..... 343/700 MS
6,070,803 A 6/2000 Stobbe
6,070,804 A 6/2000 Miyamoto
6,072,383 A * 6/2000 Gallagher et al. ..... 340/10.2
6,075,491 A * 6/2000 Dakeya et al. ..... 340/10.1
6,100,788 A 8/2000 Frary
6,137,411 A 10/2000 Tyren ..... 340/572.1
6,150,986 A 11/2000 Sandberg et al.
6,154,635 A 11/2000 Ohta
6,172,608 B1 1/2001 Cole
6,208,235 B1 3/2001 Trontelj ..... 340/10.1
6,229,443 B1 5/2001 Roesner ..... 340/572.1
6,243,013 B1 6/2001 Duan et al. ..... 340/572.4
6,265,962 B1 7/2001 Black et al. ..... 340/10.2
6,272,320 B1 8/2001 Nandra et al.
6,272,321 B1 8/2001 Bruhnke et al.
6,281,794 B1 8/2001 Duan et al.
6,304,169 B1 * 10/2001 Blama et al. ..... 340/10.1
6,307,468 B1 10/2001 Ward, Jr.
6,307,517 B1 * 10/2001 Lee ..... 340/10.1
6,335,665 B1 1/2002 Mendelsohn ..... 333/139
6,393,045 B1 5/2002 Belcher et al.
6,424,820 B1 7/2002 Burdick et al.
6,441,804 B1 8/2002 Hsien
6,446,049 B1 9/2002 Janning et al.
6,491,230 B1 * 12/2002 Dubost et al. ..... 235/492
6,498,923 B1 12/2002 Ikefuji et al. ..... 455/41
6,650,226 B1 11/2003 Wuidart et al. ..... 340/10.1
6,650,227 B1 11/2003 Bradin ..... 340/10.3
6,650,229 B1 11/2003 Wuidart et al. ..... 340/10.4
6,654,466 B1 11/2003 Ikefuji et al. ..... 380/270
6,690,229 B1 2/2004 Rudolph ..... 327/543
6,703,921 B1 3/2004 Wuidart et al. ..... 340/10.4
2002/0008611 A1 1/2002 Wuidart
2003/0227323 A1 12/2003 Enguent ..... 329/345

FOREIGN PATENT DOCUMENTS

DE 195 46 928 6/1997
DE 196 21 076 11/1997
DE 196 32 282 A1 2/1998
EP 0 038 877 11/1981
EP 0 369 622 5/1990
EP 0 568 067 A 11/1993
EP 0 579 332 A1 1/1994
EP 0 645 840 A 3/1995
EP 0 768 540 4/1997
EP 0 857 981 A1 8/1998
EP 0 902 475 A 3/1999
FR 2 114 026 6/1972
FR 2 746 200 9/1997
FR 2 757 952 7/1998
GB 2 298 553 A 9/1996
GB 2 231 726 A1 8/1998
JP 407245946 A 9/1995
JP 10-145267 5/1998
JP 10-203066 8/1998
WO WO 93/17842 9/1993
WO 98/20363 5/1998
WO WO 99/33017 7/1999
WO 99/43096 8/1999

OTHER PUBLICATIONS

French Search Report from French Patent Application No. 00 06065, filed May 12, 2000.

French Search Report from French Patent Application No. 00 06061, filed May 12, 2000.

French Search Report from French Patent Application No. 00 06064, filed May 12, 2000.

French Search Report from French Patent Application No. 00 06071, filed May 12, 2000.

French Search Report from French Patent Application No. 99 04549, filed Apr. 7, 1999.

* cited by examiner

ELECTROMAGNETIC FIELD GENERATION ANTENNA FOR A TRANSPONDER

BACKGROUND OF THE INVENTION

1. Field of the Invention

The present invention relates to systems using electromagnetic transponders, that is, transmitters and/or receivers (generally mobile) capable of being interrogated in a contactless and wireless manner by a unit (generally fixed), called a read and/or write terminal. Generally, transponders extract the power supply required by the electronic circuits included therein from the high-frequency field radiated by an antenna of the read and write terminal. The present invention applies to such systems, be they read-only systems, that is, including a terminal only reading the data from one or several transponders, or read/write systems, in which the transponders contain data that can be modified by the terminal.

2. Discussion of the Related Art

Systems using electromagnetic transponders are based on the use of oscillating circuits including a winding forming an antenna, on the transponder side and on the read/write terminal side. These circuits are intended for being near-field coupled when the transponder enters the field of the read/write terminal.

FIG. 1 very schematically shows a conventional example of a data exchange system of the type to which the present invention relates between a read/write terminal 1 and a transponder 10 of the type to which the present invention applies.

Generally, terminal 1 is essentially formed of a series oscillating circuit formed of an inductance L1 in series with a capacitor C1 and a resistor R1, between an output terminal 2 of an amplifier or antenna coupler (not shown) and a reference terminal 3 (generally, the ground). The antenna coupler belongs to a circuit 4 for controlling the oscillating circuit and exploiting received data including, among others, a modulator/demodulator and a microprocessor for processing the control signals and the data. The exploitation of the received data is based on a measurement of the current in the oscillating circuit or of the voltage thereacross. Circuit 4 of the terminal generally communicates with different input/output circuits (keyboard, screen, means of exchange with a server, etc.) and/or processing circuits, not shown. The circuits of the read/write terminal generally draw the power necessary to their operation from a supply circuit (not shown) connected, for example, to the electric supply system or to batteries.

A transponder 10, intended for cooperating with a terminal 1, essentially includes a parallel oscillating circuit formed of an inductance L2, in parallel with a capacitor C2 between two input terminals 11, 12 of control and processing circuits 13. Terminals 11, 12 are in practice connected to the input of a rectifying means (not shown), outputs of which form D.C. supply terminals of the circuits internal to the transponder. These circuits generally include, essentially, a microprocessor capable of communicating with other elements (for example, a memory), a demodulator of the signals received from terminal 1, and a modulator for transmitting information to the terminal.

The oscillating circuits of the terminal and of the transponder are generally tuned on the same frequency corresponding to the frequency of an excitation signal of the terminal's oscillating circuit. This high-frequency signal (for example, at 13.56 MHz) is not only used as a transmission carrier but also as a remote supply carrier for the transponder (s) located in the terminal's field. When a transponder 10 is located in the field of a terminal 1, a high-frequency voltage is generated across terminals 11 and 12 of its resonant circuit. This voltage, after being rectified and possibly clipped, is intended for providing the supply voltage of electronic circuits 13 of the transponder. For clarity, the rectifying, clipping, and supply means have not been shown in FIG. 1. In return, the data transmission from the transponder to a terminal is generally performed by modulating the load formed by resonant circuit L2, C2. The load variation is performed at the rate of a so-called back-modulation sub-carrier, of a frequency (for example, 847.5 kHz) smaller than that of the carrier.

The antennas of terminal 1 and of transponder 10 are, in FIG. 1, materialized by their equivalent electric diagrams, that is, inductances (neglecting the series resistances). In practice, a terminal 1 has a flat antenna L1 formed of a few circular turns (most often one or two turns) of relatively large diameter (for example, of a given value ranging between one and 4 inches) and antenna L2 of a transponder (for example, a card of credit card format) is formed of a few rectangular turns (most often from two to five turns) inscribed within a relatively small diameter (turns with a side from 2 to 3 inches) as compared to the diameter of antenna L1.

FIG. 2 is a simplified perspective view of a terminal and of a transponder illustrating a conventional example of antennas. Electronic circuits 4 of terminal 1, as well as capacitor C1 and resistor R1, are generally contained in base 6. Antenna L1 is, for example, supported by a printed circuit wafer 7 protruding from base 6. In FIG. 2, it is assumed that antenna L1 is formed of a single turn in which, when the terminal's oscillating circuit is excited by the high-frequency signal, a current I flows. The indicated direction of current I is arbitrary and this current is alternating. Transponder 10 is assumed to be a smart card integrating circuits 13 and antenna L2 of which includes two rectangular coplanar turns approximately describing the periphery of card 10. Capacitor C2 shown as separated from circuits 13 is generally formed by being integrated to the chip.

Conventional transponder systems generally have a limited range, that is, at a certain distance (d, FIG. 2) from the terminal, the magnetic field is insufficient to properly remotely supply a transponder. The minimum field generally ranges between 0.1 and 1 A/m according to the transponder's power consumption, which essentially differs according to whether it is or not provided with a microprocessor.

The remote supply range depends on the amount of magnetic flux emitted by the terminal or reader, which can be "intercepted" by a transponder. This amount directly depends on the coupling factor between antennas L1 and L2, which represents the flux proportion received by the transponder. The coupling factor (between 0 and 1) depends on several factors among which are the mutual inductance between antennas L1 and L2 and the respective size of the antennas, and the tuning of the oscillating circuits on the high-frequency carrier frequency. For given sizes and a given mutual inductance, the coupling is maximum when the oscillating circuits of the terminal and of the transponder are both tuned on the frequency of the remote supply carrier.

A conventional solution to increase the range consists of increasing the size of antenna L1 of the terminal. To keep the magnetic field, the intensity of the current of the excitation signal must then be proportionally increased. A first disadvantage of such a solution is that it increases the necessary system excitation power. A second disadvantage of such a solution is that such a current increase remains limited by the generator structure and requires components having significant size (in particular, a large cross-section of the conductor forming antenna L1). Further, the losses are proportional to the square of the current.

To attempt overcoming this second disadvantage, a known solution is to use, for relatively large antennas (for example, of portico type), a parallel oscillating circuit on the terminal side. This circuit is then voltage-driven and no longer current-driven, which results in a greater increase of the current in the antenna (assembled as a so-called "rejector" circuit) without requiring this current to flow through the generator. Such a solution has the advantage of limiting losses. However, this solution still causes an increase in the power consumption (due to the voltage increase to increase the power). Further, the maximum field at the center of antenna L1 is generally set by standards.

Another disadvantage, mostly present for antennas of relatively large size, is that the magnetic field is not homogeneous in front of the antenna, that is, for a given distance, the intensity of the magnetic field strongly varies according to the position in a plane parallel to the antenna. This disadvantage of course cumulates with the foregoing when the range is desired to be increased by increasing the size of the antenna, that is, the surface area in which it is inscribed.

U.S. Pat. No. 5,142,292 discloses an antenna including a plurality of series-connected coils for transmitting electromagnetic energy.

SUMMARY OF THE INVENTION

The present invention aims at overcoming the disadvantages of conventional transponder systems.

The present invention more specifically aims at improving the terminal efficiency, especially by optimizing the impedance matching of the oscillating circuit.

The present invention aims, in particular, at improving the range and/or the signal level available at a given distance, from a read and/or write transponder terminal.

The present invention also aims at improving the homogeneity of the magnetic field generated by a transponder read and/or write terminal.

The present invention also aims at providing a solution which is compatible with existing systems. More precisely, the present invention aims at providing a solution that requires no modification of the transponders and, preferably, no modification of the read/write terminal.

The present invention further aims at providing a solution generating no significant additional power consumption.

To achieve these and other objects, the present invention provides an antenna for generating an electromagnetic field including several planar inductive cells parallel connected in an array and forming, in association with at least one capacitor, an oscillating circuit adapted to being excited by a high-frequency signal.

According to an embodiment of the present invention, all cells have identical inductance values.

According to an embodiment of the present invention, the natural resonance frequency of the oscillating circuit is chosen to approximately correspond to the frequency of the excitation signal.

According to an embodiment of the present invention, the antenna is connected in series with the capacitor.

According to an embodiment of the present invention, the antenna is connected in parallel with the capacitor.

According to an embodiment of the present invention, the number of turns of each cell is chosen by taking account of the surface area in which the cells are inscribed together.

The present invention also provides a terminal for generating a high-frequency electromagnetic field for at least one transponder.

According to an embodiment of the present invention, the terminal's oscillating circuit includes a capacitor of greater value than the value that this capacitor should have if it was associated with an antenna of the same size but formed of a single cell.

The foregoing objects, features and advantages of the present invention, will be discussed in detail in the following non-limiting description of specific embodiments in connection with the accompanying drawings.

DETAILED DESCRIPTION

Figure 1:
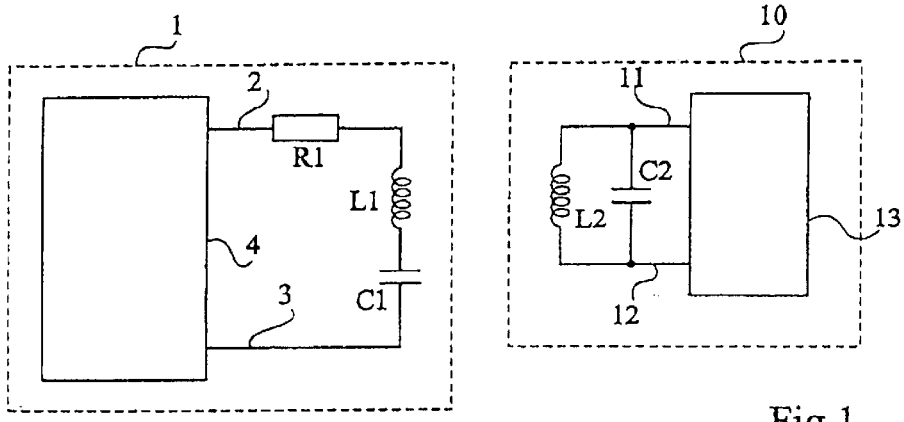
Fig 1 (Prior Art)
FIG. 1, previously described, very schematically shows an electric diagram of a conventional transponder system.

The same elements have been referred to with the same references in the different drawings. For clarity, these have been drawn out of scale and only those elements of a terminal or of a transponder which are necessary to the understanding of the present invention have been illustrated in the drawings and will be described hereafter. In particular, the circuits for processing and exploiting the exchanged data have not been detailed since they are conventional. They will most often be dedicated or programmable digital circuits. Further, the present invention applies whatever the type of transponder (credit card type, electronic label, etc.), be it or not provided with a microprocessor.

A feature of the present invention is to provide an array antenna, that is, an antenna formed of several independent and coplanar loops or cells that are connected in parallel.

Figure 2:
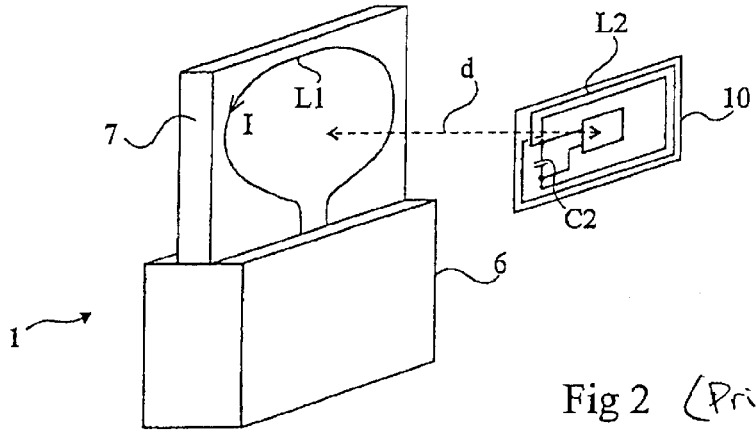
Fig 2 (Prior Art)
FIG. 2, previously described, shows an example of shapes of antennas of a conventional transponder system.
Figure 3A:
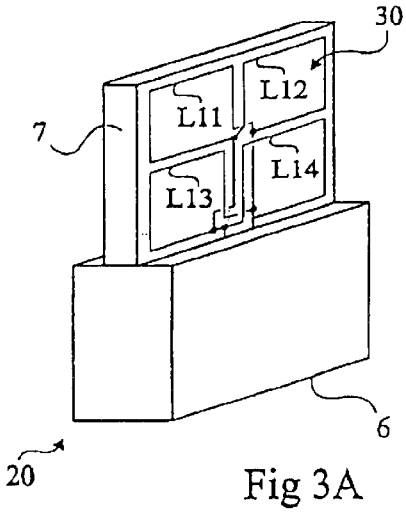
FIG. 3A very schematically shows a first embodiment of a terminal for generating an electromagnetic field according to the present invention.
Figure 3B:
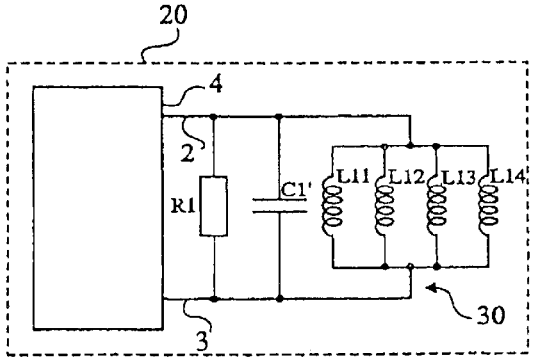
FIG. 3B shows a simplified electric diagram of the first embodiment of the present invention.

FIGS. 3A and 3B very schematically show a first embodiment of a terminal for generating an electromagnetic field according to the present invention. FIG. 3A illustrates an example of a structural implementation to be compared with the representation of FIG. 2. FIG. 3B shows the equivalent electric diagram to be compared with the representation of FIG. 1.

A terminal 20 according to the present invention differs from a conventional terminal by its oscillating circuit. For the rest, it includes circuits 4 for controlling, exploiting, and processing data, a base 6, and a support 7 for the antenna, for example, a printed circuit wafer on which are made the conductive tracks forming the antenna.

According to the present invention, antenna 30 of the oscillating circuit is formed of several coplanar and non-concentric cells or loops, which are placed or formed side by side on support 7, each cell being formed of one or several coplanar concentric turns. Electrically, this amounts to providing several (for example, four) inductances L11, L12, L13, and L14 connected, preferably, in parallel.

It should be noted that the association of the inductances in an antenna array must be such that all cells generate fields, the lines of which add (all are in the same direction).

In the embodiment of FIGS. 3A and 3B, the oscillating circuit itself is a parallel or "rejector" circuit, that is, resistor R1 and capacitor C1' are connected in parallel with antenna 30. As an alternative, an antenna according to the present invention may be assembled in a series oscillating circuit, resistor R1 then being in series with capacitor C1' and antenna 30 (that is, the parallel connection of inductances L11, L12, L13, and L14). A parallel or series oscillating circuit may be provided according to whether a current or voltage control is provided. The choice will be made, for example, according to the required excitation power.

Other alternatives may of course be envisaged to connect the inductances in parallel with a common capacitor.

Providing several distinct inductances to form the antenna has several advantages.

A first advantage of the present invention is that by providing several coplanar cells to form the terminal's oscillating circuit, the field lines are more homogeneous in the antenna's axis (a virtual axis approximately corresponding to the perpendicular line at the center of the circle in which the antenna cells are inscribed), whereby the power received by the transponder in the field is also more homogeneous for different lateral shifting positions with respect to the system's axis of symmetry.

Another advantage is that the circuit feasibility is guaranteed. Indeed, due to the high frequencies (several tens of MHz) of the carrier and to the antenna size (surface area) requirement to increase the range, the value of the capacitor required for a conventional antenna can become smaller than the stray capacitance of the inductance, making its realization impossible. By providing an association of several inductances in parallel, the use of one or several capacitors of greater value, and thus more easily greater than the respective stray capacitances of the inductances, is allowed. In the example of FIG. 3B, this amounts to saying that, for a given equivalent antenna surface area, the fact of placing four parallel inductances of the same value (L11=L12=L13=L14=L) divides the resulting value (for example, provides a resulting inductance L/4) and enables use of a capacitor C1' of a value 4 times greater than the value that it would have had with a single cell of same inductance value. Indeed, to keep the tuning of the oscillating circuit on the frequency (corresponding to a pulse ω) of the excitation signal, relation $1/((L/4)*C1')=\omega^2$ must be respected.

Another advantage of a parallel association of the cells forming the antenna is that by decreasing the value of the equivalent inductance, the overvoltage developed thereacross and, accordingly, the parasitic electric field resulting therefrom, are decreased.

Another advantage of the present invention is that its implementation requires no modification of the transponder. Further, on the terminal side, the modification is minor since the antenna of the present invention can include, like conventional antennas, two connection terminals only for the terminal's circuits.

It should be noted that capacitor C1' (FIGS. 3A and 3B) can be replaced with several capacitors respectively associated with the different cells. However, an advantage of providing a capacitor common to all cells is that this enables maximizing its value so that there is no longer a risk that the value of the capacitor is of the same order of magnitude as the stray capacitances of inductances L11, L12, L13, and L14. Thus, the use of a cell array finds application, in particular (but not exclusively), in portico type systems where the respect of the condition of general size of the terminal's antenna would result in too small a capacitor C1 (FIG. 1). Further, since capacitors can be adjustable, it is preferable to perform a single adjustment.

Figure 4A:
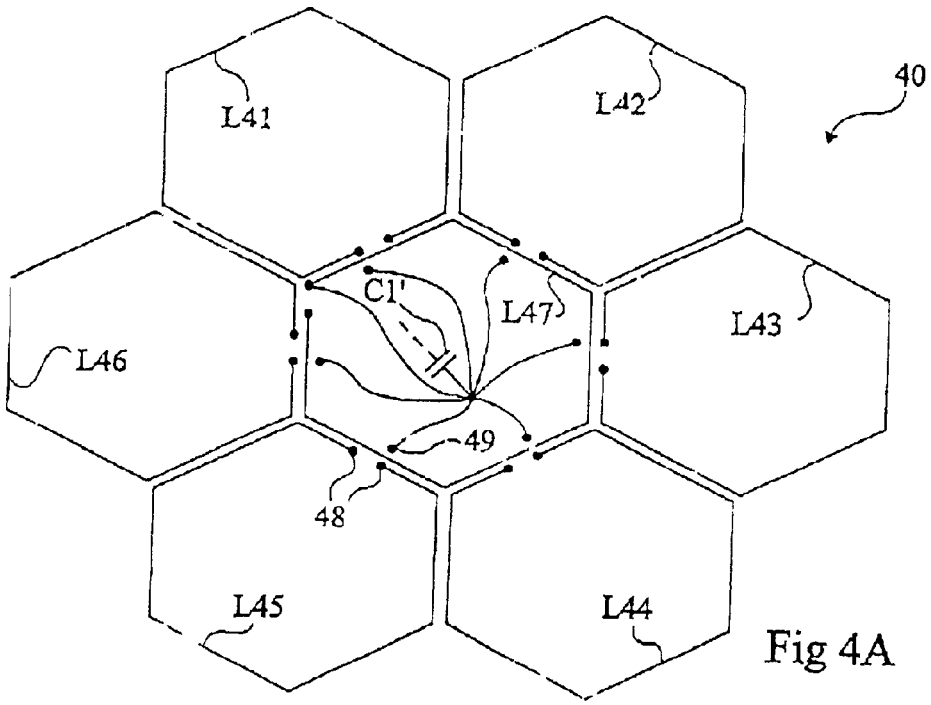
FIGS. 4A and 4B show, respectively as seen from a first and from a second surface, a second embodiment of an antenna according to the present invention.
Figure 4B:
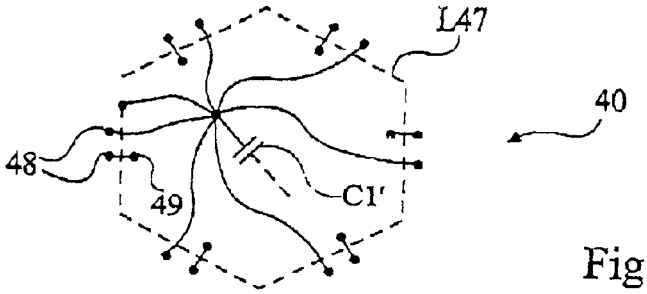

FIGS. 4A and 4B schematically show, respectively by a view from a first surface and from a second opposite surface, an antenna 40 according to a second embodiment of the present invention. The cells are placed in a "honeycomb". For example, six cells L41, L42, L43, L44, L45, and L46 having the shape of a hexagonal spiral are arranged around a seventh cell L47 also in the form of a hexagonal spiral. Such a structure optimizes the homogeneity of the field lines. FIG. 4A shows, for example, the first surface of a printed circuit on which are formed the different cells of antenna 40 and FIG. 4B shows, for example, the second surface of this circuit enabling obtaining the interconnections. A capacitor C1 is either external or formed in the printed circuit (for example, across its thickness). The two ends of each spiral L41, L42, L43, L44, L45, and L46 and one end of central spiral L47 are connected to vias 48 enabling crossing of the printed circuit. The first ends are connected to a first electrode of capacitor C1 at the second surface (FIG. 5B). The second ends of the first six spirals cross back the circuit (by vias 49) inside of spiral L47, to be connected, with the second end thereof, to the second electrode of capacitor C1 at the first surface (FIG. 5A). To simplify the representation, only central spiral L47 has been shown (in dotted lines) in FIG. 4B.

In the example of FIGS. 4A and 4B, an association of cells in parallel assembled in a parallel oscillating circuit has been considered, but it should be noted that the optimizing of the surface occupied, obtained by the honeycomb structure can be valuable in a parallel association of the cells in a series oscillating circuit.

Of course, the present invention is likely to have various alterations, modifications, and improvements which will readily occur to those skilled in the art. In particular, the geometric sizing and the value of the inductances will be chosen according to the application and, in particular, to the desired range and to the desired excitation frequencies and powers. For example, after having determined the size of the cells and the value of the capacitance, the number of turns of the antennas is determined according to the inductances desired to respect the tuning. Further, the choice of the geometry (circular, rectangular, etc.) of the antennas may depend on factors (for example, the place of implantation, the terminal shape, etc.) other than those of the present invention.

To determine the number of turns of the cells of an antenna according to the present invention, account will preferably be taken of the following characteristics.

As a first approximation, it may be considered that the value of an inductance wound in a same plane is directly proportional to the square of the number of turns and to the average surface area in which the turns are inscribed. Magnetic field H, in the plane and at the center of a circular inductance of N turns of average diameter D, approximately amounts to N*I/D, where I represents the current. According to the present invention, this reasoning is applied while assuming that, whatever its shape (square, rectangular, hexagonal, circular, oval, etc.), a cell is inscribed in a circle of diameter D, as well as the antenna formed of the plurality of cells is inscribed in a circle of diameter D'. Based on this assumption, it is possible to determine the number of turns that the cells must have according to the other parameters that are determined. In particular, it will be chosen to enhance the equivalent inductance or the field according to the type of terminal and, more specifically, to the general size desired for the antenna.

Indeed, for an antenna of one cell, it may be considered that the inductance is four times as high for two turns than for a single one. Assuming an excitation by the same current, the field at the center and in the plane of the cell is doubled while passing from one to two turns.

By applying this reasoning to a comparison between a large antenna of a single cell and an antenna of same size of several cells connected in parallel and inscribed in the same surface, a relatively high number of turns may be chosen if it is desired to favor the field increase and a relatively small number of turns may be chosen to enhance a decrease of the equivalent inductance.

For example, the field resulting from 4 cells in parallel of 4 turns each is, at the center of the antenna, substantially the same as that of a cell of the same general surface area and of 2 turns, while the value of the equivalent inductance is divided by 4. This is a particularly valuable effect to increase the value of the oscillating circuit's capacitor and to get rid of the problems of stray capacitances in large antennas.

As a comparison, the equivalent inductance of 4 cells in parallel of 8 turns each is approximately the same as the inductance of a cell of same general surface area and of 2 turns while the resulting field is, at the center of the antenna, approximately doubled. This case will thus be favored for small antennas.

Among the applications of the present invention are contactless chip cards (for example, identification cards for access control, electronic purse cards, cards for storing information about the card holder, consumer fidelity cards, toll television cards, etc.) and read or read/write systems for these cards (for example, access control terminals or porticoes, automatic dispensers, computer terminals, and telephone terminals televisions or satellite decoders, etc.).

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. An antenna for generating an electromagnetic field, including a plurality of inductive cells parallel connected in a planar array and forming, in association with at least one capacitor, an oscillating circuit adapted to connect to a high-frequency excitation signal.

2. The antenna of claim 1, wherein all cells have identical inductance values.

3. The antenna of claim 2, wherein a natural resonance frequency of the oscillating circuit is chosen to approximately correspond to a frequency of the excitation signal.

4. The antenna of claim 1, connected in series with the at least one capacitor.

5. The antenna of claim 1, connected in parallel with the at least one capacitor.

6. The antenna of claim 1, wherein each cell includes a winding having a number of turns, the number of turns selected based on a surface area of the planar array of cells.

7. A terminal for generating a high-frequency electromagnetic field for at least one transponder, including the antenna of claim 1.

8. The terminal of claim 7, wherein the oscillating circuit has a natural resonance frequency and the at least one capacitor has a greater capacitance than would a capacitor included as part of an antenna of a same size and having a same natural resonance frequency but formed of a single inductive cell.

9. The antenna of claim 1, each inductive cell being formed by one or more coplanar and concentric turns.

10. The antenna of claim 9, the coplanar and concentric turns being of a hexagonal geometry.

11. The antenna of claim 10, the inductive cells of the antenna being of a hexagonal geometry and forming groups of seven inductive cells that share the at least one capacitor.

12. The antenna of claim 11, wherein the inductive cells of a group of seven inductive cells form connections with the terminals of the shared at least one capacitor on the back side of a printed circuit upon which the inductive cells are formed.

13. The antenna of claim 12, wherein each side of one inductive cell of the group of seven inductive cells is adjacent to a side of each of the other six inductive cells of the group of seven inductive cells.

14. The antenna of claim 11, the at least one capacitor being formed across a thickness of a printed circuit upon which the inductive cells are formed.

15. The antenna of claim 1, the antenna being part of an integrated circuit.

16. The antenna of claim 1, wherein the plurality of inductive cells includes at least three inductive cells.

17. The antenna of claim 1, wherein the planar array includes at least two columns of inductive cells and at least two rows of inductive cells.

18. An antenna for generating an electromagnetic field, comprising a plurality of inductive cells electrically connected in parallel and arranged in a planar array;

wherein the plurality of inductive cells are operative to connect to a high frequency excitation signal.

19. The antenna of claim 18, further comprising at least one capacitor, such that the at least one capacitor and the plurality of inductive cells form, in combination, an oscillating circuit.

20. The antenna of claim 19, the at least one capacitor being formed across a thickness of a printed circuit upon which the inductive cells are formed.

21. The antenna of claim 18, each inductive cell being formed by one or more coplanar and concentric turns.

22. The antenna of claim 21, the coplanar and concentric turns being of a hexagonal geometry.

23. The antenna of claim 22, the inductive cells of the antenna being of a hexagonal geometry and forming groups of seven inductive cells that share the at least one capacitor.

24. The antenna of claim 23, wherein the inductive cells of a group of seven inductive cells form connections with the terminals of the shared at least one capacitor on the back side of a printed circuit upon which the inductive cells are formed.

25. The antenna of claim 24, wherein each side of a one inductive cell of a group of seven inductive cells is adjacent to a single side of each of the other six inductive cells of the group of seven inductive cells.

26. The antenna of claim 18, the antenna being part of an integrated circuit.

27. The antenna of claim 18, wherein the plurality of inductive cells includes at least three inductive cells.

28. The antenna of claim 18, wherein the planar array includes at least two columns of inductive cells and at least two rows of inductive cells.

* * * * *